US009812271B2

(12) United States Patent
Chu

(10) Patent No.: US 9,812,271 B2
(45) Date of Patent: Nov. 7, 2017

(54) PUSH TYPE SWITCH

(71) Applicant: Ching-Hsiung Chu, Taipei (TW)

(72) Inventor: Ching-Hsiung Chu, Taipei (TW)

( * ) Notice: Subject to any disclaimer, the term of this patent is extended or adjusted under 35 U.S.C. 154(b) by 0 days.

(21) Appl. No.: 15/076,674

(22) Filed: Mar. 22, 2016

(65) Prior Publication Data

US 2017/0278648 A1 Sep. 28, 2017

(51) Int. Cl.

| | |
|---|---|
| ***H01H 1/14*** | (2006.01) |
| ***H01H 13/14*** | (2006.01) |
| ***H01H 13/02*** | (2006.01) |
| ***H01H 13/06*** | (2006.01) |

(52) U.S. Cl.

CPC ..... *H01H 13/023* (2013.01); *H01H 1/14* (2013.01); *H01H 13/06* (2013.01); *H01H 13/14* (2013.01); *H01H 2219/036* (2013.01)

(58) Field of Classification Search

CPC ..... H01H 13/023; H01H 13/06; H01H 13/14; H01H 1/14; H01H 2219/036

USPC ..... 200/5 A, 329, 336, 339, 529, 538, 200/557–559, 553, 401, 409, 457, 459, 4, 200/6 R

See application file for complete search history.

(56) References Cited

U.S. PATENT DOCUMENTS

| | | | | |
|---|---|---|---|---|
| 5,959,271 | A * | 9/1999 | Matsuhashi | H01H 13/18 200/61.41 |
| 2010/0084251 | A1* | 4/2010 | Rajagopal | H01H 13/503 200/5 A |
| 2010/0188329 | A1* | 7/2010 | Lorenzo Riera | H01H 13/023 345/156 |

* cited by examiner

*Primary Examiner* — Anthony R. Jimenez

(57) ABSTRACT

A push type switch includes a mounting base, a depressing module, a base board including at least a contact portion, a lighting module, a terminal group, and at least a conductive element. The depressing module includes a cap and a connecting peg movably connected to the mounting base. The cap has a light-permeable side portion spaced apart from the mounting base to form an interval. The lighting module includes a flat flexible cable and a plurality of lighting elements located at the interval. When the depressing module is being pushed to depress and deform the at least a conductive element to enable the conductive element to electrically contact the contact portion, the terminal group transmits electrical signals to allow the plurality of lighting elements to light with multiple lighting modes.

8 Claims, 3 Drawing Sheets

PUSH TYPE SWITCH

BACKGROUND OF THE INVENTION

1. Field of the Invention

The present invention relates to a switch, and particularly to a push type switch being capable of providing circling light emission and preventing water permeation.

2. Related Art

As is well known, electrical switches vary in size and specifications, and are widely used in most electrical products or appliances. General precision equipments, small equipments or electric appliances usually use an electronic switch, and most electronic switches are smart switches, micro switches and touch switches. Since these types of switches have a light, thin, short and compact design, therefore they can be applied to electronic devices and instruments with a very limited space or having small or micro switches, such as the 3C electronic products or microcomputers.

A conventional push type switch includes a cap lid, a base seat, and a conducting apparatus installed therein. By depressing the cap lid, the conducting apparatus is thus electrically triggered to generate and transmit electrical signals to an applied product so as to enable the applied product to perform corresponding functions. However, the conventional push type switch is not capable of providing feedback to a user as to recognize whether the switch is being successfully triggered. As a result, a conventional switch is improved to be equipped with a lighting element which is disposed on a bottom of the base seat for indicating the status of the switch. However, the lighting element is spaced far away from the cap lid and surrounded by peripheral walls of the base seat that results in a poor lighting performance. Furthermore, such lighting element merely emits light in a simple mode and thus is difficult for the user to recognize it. Moreover, a conventional push type switch is inefficient to avoid water permeation that external water tends to permeate into internals of the switch and dampen electronic components of the applied product, whereby rendering the switch or the applied product difficult to control or even ineffective.

SUMMARY OF THE INVENTION

Accordingly, an object of the present invention is to provide a push type switch capable of providing circling light emission for recognizing whether the switch has been properly actuated and for producing various visional effects.

Another object of the present invention is to provide a push type switch being capable of avoiding water permeation into insides of an application product.

To achieve the above-mentioned objects, the push type switch comprises a mounting base comprising a wall body and an accommodating space being surrounded by the wall body, the wall body including a fixing portion. A depressing module comprises a cap and a connecting peg extending out of the cap for being movably connected to the mounting base in the accommodating space, the cap having a light-permeable side portion spaced apart from the fixing portion of the mounting base so as to form an interval in between the side portion and the fixing portion. A base board is disposed in the accommodating space and includes at least a contact portion formed thereon. A lighting module comprises a flat flexible cable extending along the fixing portion of the mounting base, and a plurality of lighting elements configured on the flat flexible cable, the flat flexible cable comprising an extension segment extending from the flat flexible cable to connect the base board, and the plurality of lighting elements being located at the interval. A terminal group is electrically connected to the base board. At least a conductive element is flexible and disposed on the base board corresponding to the at least a contact portion. When the depressing module is being pushed to depress and deform the at least a conductive element to enable the conductive element to electrically contact the contact portion, the terminal group transmits electrical signals to allow the plurality of lighting elements to light with multiple lighting modes In one aspect of the present invention, the mounting base further comprises a waterproof gasket mounted to the wall body for being engaged with a mating slot.

In another aspect of the present invention, the wall body of the mounting base protrudes laterally to form a platform including a plurality of grooves, the waterproof gasket including a plurality of engaging portions for correspondingly engaging the grooves such that the waterproof gasket overlaps the platform and forms a stair-like shape with the platform.

In another aspect of the present invention, the number of the at least a conductive element is two, and the two conductive elements are spaced apart from each other so as to evenly bear a pressing force from the depressing module, the base board includes two the contact portions corresponding in position to the two conductive elements, the terminal group comprises multiple power terminals, multiple switch signal terminals respectively electrically connecting the contact portions, and multiple triggering terminals for triggering the lighting elements, and when the two conductive elements are not in contact with the contact portions, a first electrical signal is generated and transmitted through the switch signal terminals, and when the conducive elements are both in electrical contact with the contact portions, a second electrical signal different to the first electrical signal is generated.

The push type switch of the present invention utilizes the flat flexible cable equipped with the plurality of lighting elements in cooperation with the operation of the depressing module to provide visual effects for users, so as to overcome the drawbacks that conventional switches fail to provide feedback to users for recognizing whether the switch is being successfully actuated. Additionally, the lighting elements located adjacent to the cap efficiently increase the luminance, so as to be seen clearly from outside. Furthermore, the stair-shape of the waterproof gasket and the platform efficiently avoid water or moisture permeating into the inside of the application product.

DESCRIPTION OF THE PREFERRED EMBODIMENTS

Figure 1:
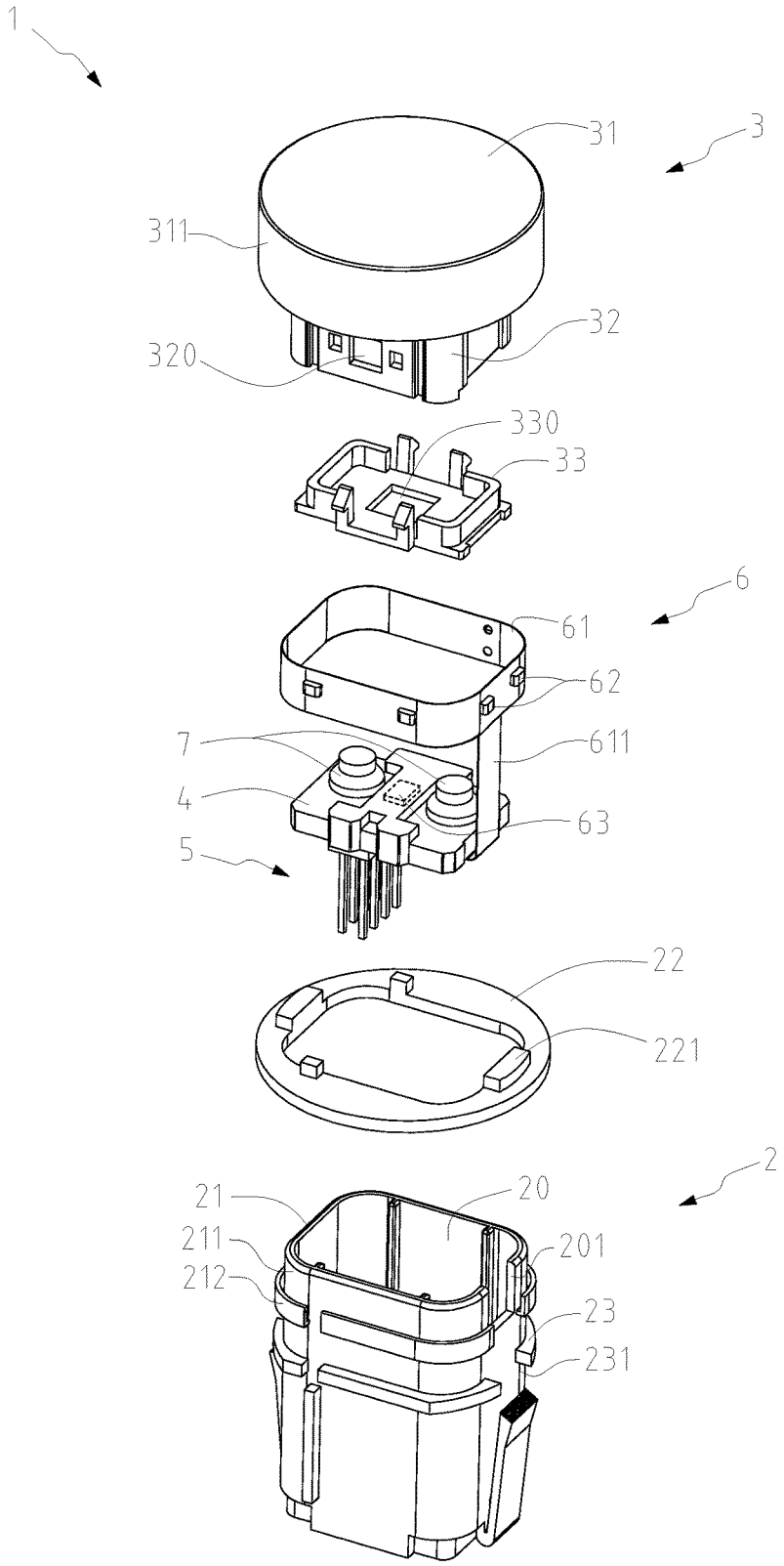
FIG. 1 is a schematic perspective exploded view of a push type switch of the present invention.
Figure 2:
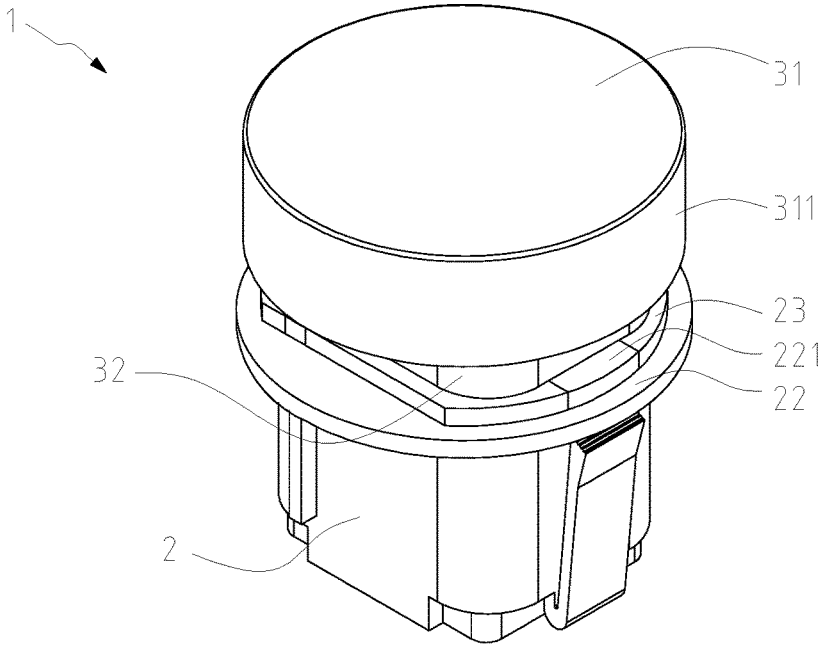
FIG. 2 is a perspective assembly view of FIG. 1.
Figure 3:
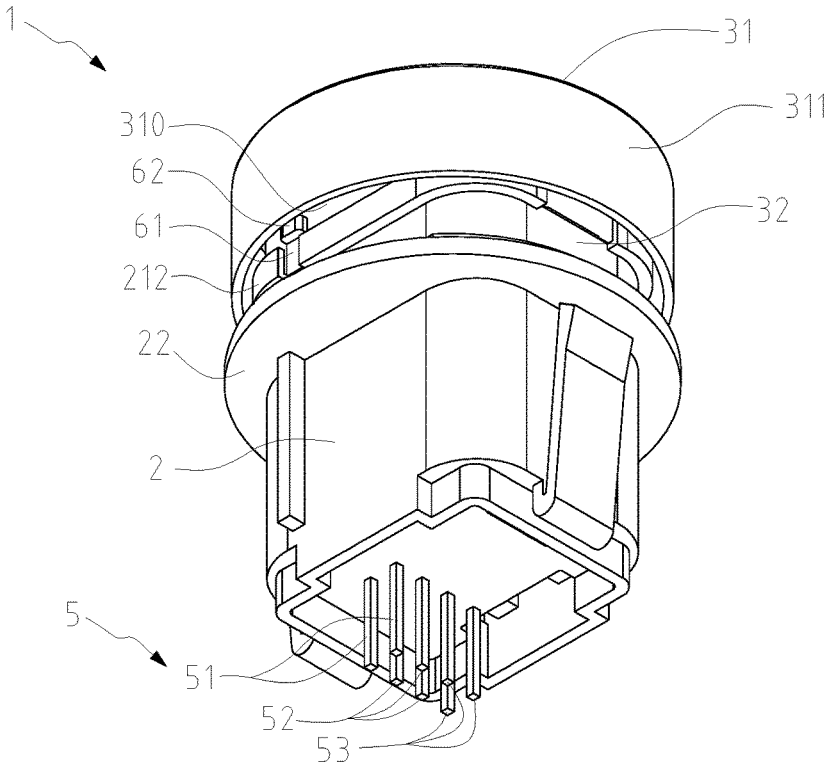
FIG. 3 is a bottom perspective view of the push type switch of the present invention.
Figure 4:
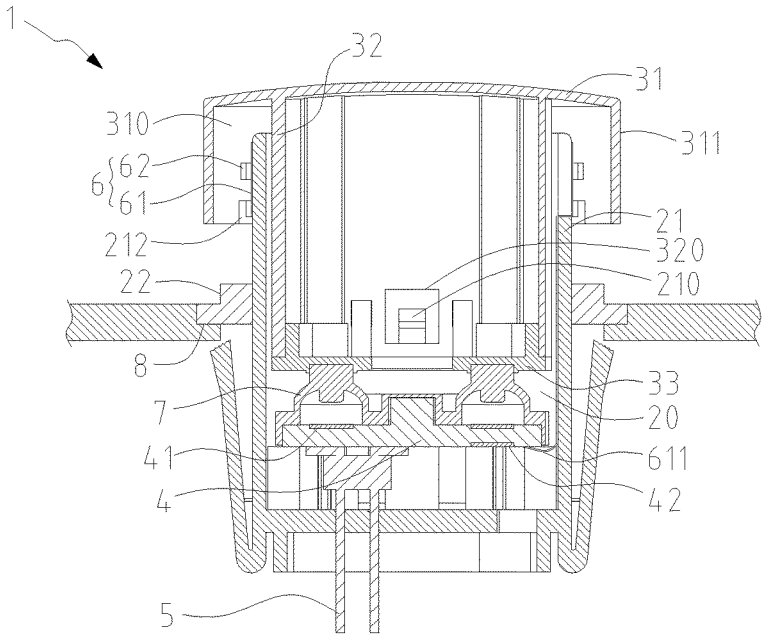
FIG. 4 is a schematic cross-sectional view of the push type switch of the present invention.

Referring to FIG. 1 to FIG. 3 illustrating a preferable embodiment of a push type switch of the present invention, the push type switch 1 is applicable to a variety of electric appliances, controlling panels of vehicles, or controllers of video game consoles. The push type switch 1 of the present invention comprises a mounting base 2, a depressing module 3, a base board 4, a terminal group 5, a lighting module 6, and two conductive elements 7. The mounting base 2 comprises a wall body 21 and an accommodating space 20 surrounded by the wall body 21. The wall body 21 surrounds the accommodating space 20 to form the mounting base 2, and includes a fixing portion 211 which is defined on an outer surface of the wall body 21 and located adjacent to a top of the mounting base 2. Specifically, the fixing portion 211 is formed around the wall body 21. The fixing portion 211 includes a fixing frame 212 having an L shape in cross section. The wall body 21 includes two protruding portions 210 (as shown in FIG. 4) which are located opposite to each other and respectively protrude inward toward the accommodating space 20.

Figure 5:
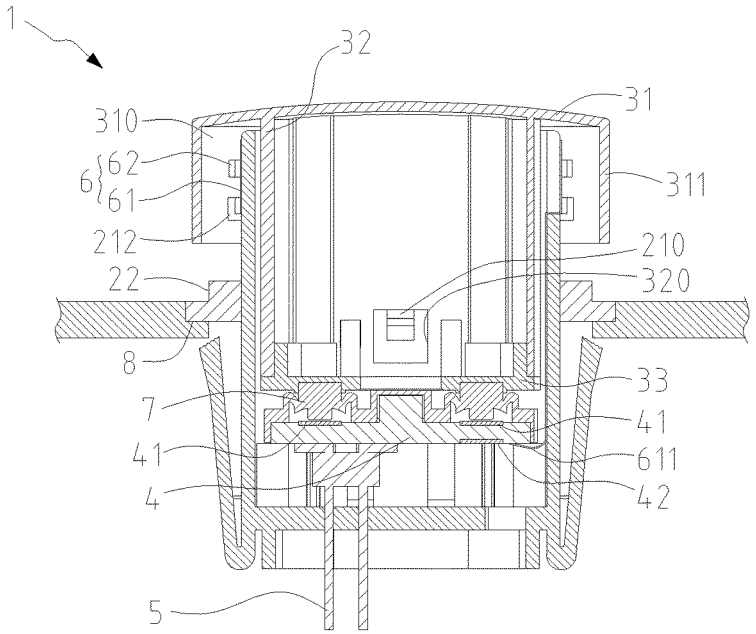
FIG. 5 schematically shows the push type switch of FIG. 4 being depressed.

The depressing module 3 comprises a cap 31 and a connecting peg 32 extending out of the cap 31 for being movably connected to the mounting base 2 in the accommodating space 20. The whole cap 31 is made of a light-permeable material, where a peripheral side thereof integrally bends downward to form a light-permeable side portion 311. The side portion 311 is spaced apart from the fixing portion 211 of the mounting base 2 so as to form an interval 310 in between the side portion 311 and the fixing portion 211. The connecting peg 32 forms two recessed portions 320 for being correspondingly engaged with the protruding portions 210 in such a way that the recessed portions 320 are movable along the protruding portions 210 while the depressing module 3 is depressed. In other words, the recessed portion 320 has an area larger than that of the protruding portion 210, where one end of the protruding portion 210 abuts against a lower side of the recessed portion 320 when the depressing module 3 is not being depressed so as to limit the moving course of the connecting peg 32 (as shown in FIGS. 4 and 5). Additionally, the depressing module 3 is capable of being detached from the mounting base 2 through the disengagement of the protruding portions 210 and the though holes 320. A depressing seat 33 is detachably connected to a bottom of the connecting peg 32. The depressing seat 33 is formed with a through hole 330, which is corresponding to a lighting unit 63 being provided on a middle of the base board 4 (as shown in FIG. 1), so that the lighting unit 63 passes through the through hole 330 where light emitted by the lighting unit 63 can be seen from a top of the cap 31. It is noted that the depressing seat 33 is used to depress the conductive elements 7, and is also of benefit to strengthen the structural strength of the connecting peg 32.

The base board 4 is disposed in the accommodating space 20 and includes two contact portion 41 formed thereon. A programmable logic controller 42 is built in the base board 4 for presetting multiple lighting modes of a plurality of lighting elements 62 (described below). The two contact portions 41 are made of metal and configured to correspond to the conductive elements 7. The terminal group 5 is electrically connected to the base board 4 and penetrates a bottom of the mounting base 2 for being electrically connected to an application product (not shown).

The lighting module 6 comprises a flat flexible cable 61 and eight lighting elements 62 configured on the flat flexible cable 61. The lighting elements 62 can be light emitting diodes or organic light emitting diodes and are spaced apart from each other. The flat flexible cable 61 extends along the fixing portion 211 of the wall body 21 and is disposed on the fixing frame 212 from a top of the mounting base 2 to be held and positioned by the fixing frame 212. The flat flexible cable 61 comprises an extension segment 611, one end of which passes through a gap 201 formed on the top of the mounting base 2 to be placed between the connecting peg 32 and the wall body 21 in the accommodating space 20 (as shown in FIGS. 1 and 4), another end extends to connect the base board 4. The lighting elements 62 are located at the interval 310 and face the side portion 311 of the cap 31, wherein the side portion 311 extends downward and below the lighting elements 62 so as to hide the lighting elements 62. One end of the interval 310 is open to a bottom of the cap 31 to facilitate assembly of the cap 31 and the mounting base 2. In the preferable embodiment, the lighting elements 62 are capable of lighting with the multiple lighting modes through the programmable logic controller 42. For example, the lighting elements 62 are flashing one by one in sequence around the cap 31, or all constantly burn, or all flash. In one embodiment, the lighting elements 62 are preset to light as soon as the push type switch 1 is electrified. Because the lighting elements 62 are disposed on an outer face of the wall body 2, the light emitted by the lighting elements 62 can be seen from the side portion 311 of the cap 31, and is not interfered by the light of the lighting unit 63.

Each of the conductive elements 7 is flexible and made of conductive silicon, and is located between the base board 4 and the depressing seat 33. The two conductive elements 7 are spaced apart from each other so as to evenly bear a pressing force from the depressing module 3.

As shown in FIG. 3, specifically, the terminal group 5 comprises two switch signal terminals 51 respectively electrically connecting the contact portions 41, three triggering terminals 52 for triggering the lighting elements 62, and three power terminals 53. When the power terminals 53 are electrified and the two conductive elements 7 are not in contact with the contact portions 41 (as shown in FIG. 4), a first electrical signal is generated and transmitted through the switch signal terminals 51, such that, for example, the contact portion 41 at the left side of the base board 4 represents the positive pole, and the contact portion 41 at the right side represents the negative pole. When the two conductive elements 7 are in contact with the contact portions 41 (as shown in FIG. 5), a second electrical signal different to the first electrical signal is generated and transmitted through the switch signal terminals 51, such that, for example, the contact portion 41 at the left side turns to the negative pole, and the contact portion 41 at the right side turns to the positive pole, so as to create dual-loop circuitry. Therefore, once electrical signals transmitted through the switch signal terminals 51 are neither the first electrical signal nor the second electrical signal, a contact of the conductive elements and the contact portions 41 is thought to be inappropriate or incorrect. In other words, the switch signal terminals 51, the conductive elements 7, and the contact portions 41 in combination with the dual-loop circuitry built in the base board 4 are to achieve a purpose of error detection for determining whether the conductive elements 7 and the contact portions 41 are in well contact, whereby ensuring that the switch 1 is being properly triggered.

Referring to FIGS. 1 and 2, the mounting base 2 further comprises a waterproof gasket 22 mounted to the wall body 21 for engaging a mating slot 8 (as shown in FIG. 4). An outer face of the wall body 21 protrudes laterally to form a platform 23 including a plurality of grooves 231 arranged around the wall body 21. The waterproof gasket 22 includes a plurality of engaging portions 221 protruding upward for correspondingly engaging the grooves 231 such that the waterproof gasket 22 overlaps the platform 23 and forms a stair-like shape with the platform 23. In this manner, water or moisture is not likely to permeate to the inside of the switch 1 from the juncture of the switch 1 and the slot 8 of the application product, whereby preventing internal components of the application product from being dampened by external water or moisture.

Referring to FIGS. 4 and 5, in use of the push type switch 1 of the present invention, push the top of the cap 31 to enable the depressing module 3 to move downward toward the accommodating space 20 and to simultaneously depress the conductive elements 7 causing the conductive elements 7 to deform and electrically contact the contact portions 41, whereby transmitting electrical signals through the terminal group 5 to trigger the switch 1 to control the application product. Meanwhile, the plurality of lighting elements 62 light with the multiple lighting modes preset by the programmable logic controller 42, where the light emitted by the lighting elements 62 are permeable to the side portion 311 of the cap 31 so as to indicate that the switch 1 has been actuated, and to further produce various visional effects corresponding to functions of the application product.

Accordingly, the push type switch 1 of the present invention utilizes the flat flexible cable 61 equipped with the plurality of lighting elements 62 in cooperation with the operation of the depressing module 3 to provide visual effects for users, so as to overcome the drawbacks that conventional switches fail to provide feedback to users for recognizing whether the switch is being successfully actuated. Additionally, the lighting elements 62 located adjacent to the cap 31 efficiently increase the luminance, so as to be seen clearly from outside. Furthermore, the stair-shape of the waterproof gasket 22 and the platform 23 efficiently avoid water or moisture permeating into the inside of the application product.

It is understood that the invention may be embodied in other forms within the scope of the claims. Thus the present examples and embodiments are to be considered in all respects as illustrative, and not restrictive, of the invention defined by the claims.

What is claimed is:

1. A push type switch, comprising:

a mounting base comprising a wall body and an accommodating space being surrounded by the wall body, the wall body including a fixing portion;

a depressing module comprising a cap and a connecting peg extending out of the cap for being movably connected to the mounting base in the accommodating space, the cap having a light-permeable side portion spaced apart from the fixing portion of the mounting base so as to form an interval in between the side portion and the fixing portion;

a base board disposed in the accommodating space and including at least a contact portion formed thereon;

a lighting module comprising a flat flexible cable extending along the fixing portion of the mounting base, and a plurality of lighting elements configured on the flat flexible cable, the flat flexible cable comprising an extension segment extending from the flat flexible cable to connect the base board, and the plurality of lighting elements being located at the interval;

a terminal group electrically connected to the base board; and at least a conductive element being flexible and disposed on the base board corresponding to the at least a contact portion, and when the depressing module is being pushed to depress and deform the at least a conductive element to enable the conductive element to electrically contact the at least a contact portion, the terminal group transmits electrical signals to allow the plurality of lighting elements to light with multiple lighting modes;

wherein the fixing portion of the wall body is defined on an outer surface of the wall body and located adjacent to a top of the mounting base, the fixing portion has a fixing frame located around the fixing portion for holding and positioning the flat flexible cable, and the depressing module further comprises a depressing seat being detachably connected to a bottom of the connecting peg for depressing the at least a conductive element.

2. The push type switch of claim 1, wherein one end of the interval is open to a bottom of the cap, and the side portion of the cap extends below the plurality of lighting elements.

3. The push type switch of claim 1, wherein a programmable logic controller is built in the base board for presetting the multiple lighting modes.

4. The push type switch of claim 1, wherein the wall body of the mounting base includes two protruding portions respectively protruding inward toward the accommodating space, and the connecting peg forms two recessed portions for being correspondingly engaged with the protruding portions in such a way that the recessed portions are movable along the protruding portions while the depressing module is depressed.

5. The push type switch of claim 1, wherein the mounting base further comprises a waterproof gasket mounted to the wall body for being engaged with a mating slot.

6. The push type switch of claim 5, wherein the wall body of the mounting base protrudes laterally to form a platform including a plurality of grooves, the waterproof gasket including a plurality of engaging portions for correspondingly engaging the plurality of groove such that the waterproof gasket overlaps the platform and forms a stair-like shape with the platform.

7. The push type switch of claim 1, wherein the number of the at least a conductive element is two, and the two at least a conductive elements are spaced apart from each other so as to evenly bear a pressing force from the depressing module.

8. The push type switch of claim 7, wherein the base board includes two at least a contact portions corresponding in position to the two conductive elements, the terminal group comprises multiple power terminals, multiple switch signal terminals respectively electrically connecting the two at least a contact portions, and multiple triggering terminals for triggering the plurality of lighting elements, and when the two conductive elements are not in contact with the two contact portions, a first electrical signal is generated and transmitted through the switch signal terminals, and when the two conductive elements are both in electrical contact with the two contact portions, a second electrical signal different from the first electrical signal is generated.

* * * * *